United States Patent [19]

Bianco et al.

[11] Patent Number: 4,673,136

[45] Date of Patent: Jun. 16, 1987

[54] APPARATUS FOR THE DRY DEFIBRATION OF SHEETS OF FIBROUS CELLULOSE MATERIAL AND LIKE MATERIALS

[75] Inventors: Carlo Bianco; Roberto Colleluori; Egidio De Sanctis, all of Pescara, Italy

[73] Assignee: Fameccanica S.p.A., Sambuceto di San Giovanni T., Italy

[21] Appl. No.: 746,235

[22] Filed: Jun. 18, 1985

[30] Foreign Application Priority Data

Jun. 20, 1984 [IT] Italy ..... 67634 A/84

[51] Int. Cl.[4] ..... B02C 19/12

[52] U.S. Cl. ..... 241/280; 241/28; 241/295

[58] Field of Search ..... 241/28, 277, 280, 281, 241/293, 295, 222, 241, 242, 243, 101 D, 18, 73, 282; 425/82.1

[56] References Cited

U.S. PATENT DOCUMENTS

| | | | |
|---|---|---|---|
| 54,260 | 4/1866 | Sloan | 241/280 X |
| 758,042 | 4/1904 | Bartlett | 241/277 |
| 2,403,193 | 7/1946 | Rawson | 241/277 X |
| 3,170,640 | 2/1965 | Kolts et al. | 241/73 X |
| 3,825,194 | 7/1974 | Buell | 241/18 X |
| 4,241,881 | 12/1980 | Laumer | 241/28 |

FOREIGN PATENT DOCUMENTS

| | | | |
|---|---|---|---|
| 2947190 | 5/1981 | Fed. Rep. of Germany | 241/277 |
| 549908 | 10/1956 | Italy | 241/277 |

*Primary Examiner*—Mark Rosenbaum

*Attorney, Agent, or Firm*—Lahive & Cockfield

[57] ABSTRACT

Apparatus for the dry defibration of sheets of wood pulp cellulose and like materials comprises a tubular casing to which the sheets to be defibrated are fed substantially radially and a cylindrical rotor rotatably mounted within the casing substantially coaxially of the casing itself. The rotor has external teeth for impinging on the material to be defibrated. The rotor is constituted by a plurality of externally toothed discs and spacer members connected together in a pack in an arrangement in which the spacer members alternate with toothed discs. The general plane of each disc is at a predetermined angle to planes perpendicular to the axis of rotation of the rotor whereby, during rotation, the periphery of each disc describes a respective substantially cylindrical surface coaxial with the axis of rotation of the rotor. The distance between adjacent toothed discs and the angle of inclination of the discs are selected so that the substantially cylindrical surfaces described by adjacent discs at least touch each other.

9 Claims, 9 Drawing Figures

APPARATUS FOR THE DRY DEFIBRATION OF SHEETS OF FIBROUS CELLULOSE MATERIAL AND LIKE MATERIALS

The present invention relates to apparatus for the dry defibration of sheets of fibrous cellulose material such as for example, wood pulp cellulose.

This term is meant in general to apply to an apparatus which enables the continuous dry conversion of sheets of fibrous materials into a dispersion of individual fibres in air. This dispersion is used as the basic material for the manufacture of absorbent masses such as, for example, the material termed "fluff" used in babies disposable nappies and adult incontinence pads, sanitary towels and the like.

In order to carry out the defibration, apparatus is used which is termed a "defibrator" or "disintegrator" which is constituted essentially by a horizontal-axis tubular casing within which is a cylindrical rotor which rotates at high speed within the casing.

The sheets to be defibrated are introduced into the defibrator, approximately radially of the rotor, through apertures provided in the casing wall. The rotor has projections which exert a mechanical action on the fibrous material causing the constituent fibres of the material itself to separate. The rotor draws the defibrated material along the inner wall of the casing, facilitating its mixture with air and causing the subsequent expulsion of the fibre-air dispersion from the casing through outlet apertures provided in the casing itself.

In very general terms, the features which distinguish the various types of defibrators used in industry from each other are the different rotor structures.

In some defibrators, which are essentially like hammer mills, the rotor is constituted by a roller carrying fixed or hinged impact elements on its outer surface which, possibly cooperating with tooth-shaped projections on the inner wall of the casing, can achieve a percussive action on the fragments detached from the sheet material, which impinges in an approximately radial direction on the rotor itself.

The use of this type of defibrator in industry gives rise to disadvantages due to the great noise of the apparatus, the high power consumption and the frequency with which the apparatus itself becomes clogged with consequent fire risk.

These disadvantages may be overcome at least to some extent by making use of defibrators or disintegrators in which the rotor is constituted by a roller having external teeth arranged in regular or pseudo-random distributions.

In toothed rotor defibrators the defibrating action on the sheet material is achieved substantially in correspondence with the region of impact of the teeth on the material itself. This considerably reduces the risk of clogging.

Defibrators of this type are illustrated, for example, in U.S. Pat. Nos. 3,750,962 and 3,825,194 which describe rotors constituted by a pack of discs each having a peripheral ring of teeth and being keyed on a rotary shaft coaxial with the casing. In other defibrators, a substantially similar result is achieved with a rotor constituted by a roller or cylinder provided externally with one or more helical grooves in which toothed blades are inserted. This type of defibrator, however, has a disadvantage due to the fact that any breakage of one of the blades caused by the forces to which the blade itself is subject—particularly when hard cellulose pulp is being defibrated, that is, pulp not treated with agents which reduce the bonds between the fibres of the sheet—may cause the blade to come out of its groove, giving rise to damage to the rotor and possibly even to the casing.

A disadvantage common to all the toothed rotor defibrators of known type is their lack of sensitivity to adjustment and/or control of the quality of the defibrated product.

It is not generally possible to define a criterion of quality for the defibrated product in precise quantitative terms. Theoretically, the best criterion is that which defines a high quality defibrated product as a product in which the fibres have characteristics (for example a statistical length distribution) which are as similar as possible to those of the fibres in the sheet subject to the defibration. This criterion does not, however, have absolute validity in that from the point of view of the quality of the product in which the defibrated material is used (for example the absorbent mass in a nappy) it may be advantageous to provide a defibrated material in which the fibres have a different length from those of the starting material, or small percentages of material which is not wholly defibrated. For example small percentages of crushed but not completely defibrated material may have a beneficial influence on the quality of the final product.

It is thus important to be able to provide defibrators which are versatile and able to produce defibrated products having different characteristics depending on the qualitative criterion considered the optimum for the subsequent use.

The object of the present invention is thus to provide apparatus for the dry defibration of sheets of fibrous cellulose material and like materials which, in addition to having low power dissipation during operation and having structural characteristics which make it easy to manufacture and maintain, is adaptable so as to allow, on the one hand, the treatment of cellulose pulp of different types and, on the other hand, variation in the characteristics of the defibrated product in dependence on specific applicational requirements.

According to the present invention, this object is acieved by virtue of apparatus for the dry defibration of sheets of fibrous cellulose material and like materials, comprising a generally cylindrical rotor rotatable about its main axis and provided with teeth on its outer surface for impinging on the material to be defibrated, and a casing surrounding the rotor to which the sheets to be defibrated are fed approximately radially relative to the rotor itself, characterised in that the rotor comprises a plurality of discs each having a toothed outer edge connected together in a pack in an arrangement in which each disc lies in a plane at a predetermined angle other than zero to planes perpendicular to the main axis of the rotor, whereby, during rotation of the rotor itself, the outer toothed edge of each disc describes a respective substantially cylindrical surface coaxial with the main axis and at least marginally mating with the similar surfaces described by the outer edges of the adjacent discs.

According to another aspect of the invention, each tooth of the rotor has a front flank which is intended to impinge on the material to be defibrated and which lies substantially in a respective radial plane of the rotor: the sheets of material to be defibrated are then fed to the apparatus in a plane at a predetermined angle other than zero to the radial plane of the rotor, passing through the feed region of the sheets themselves, in an arrangement in which the feed plane of the sheets to be defibrated is at an angle of less than 180° to the radial plane of the rotor containing the front flanks of the teeth which impinge on the sheets at that moment.

Both these characteristics, and in particular the first, mean that the teeth impinge progressively on the sheets to be defibrated.

Further characteristics and advantages of the invention will be better understood with reference to the description which follows, given purely by way of non-limiting example, with reference to the appended drawings, in which.

Figure 1:
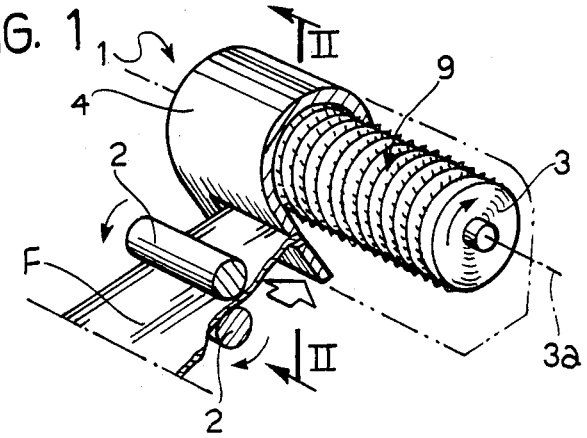
FIG. 1 is a partially cut-away perspective view illustrating apparatus according to the invention schematically.
Figure 3:
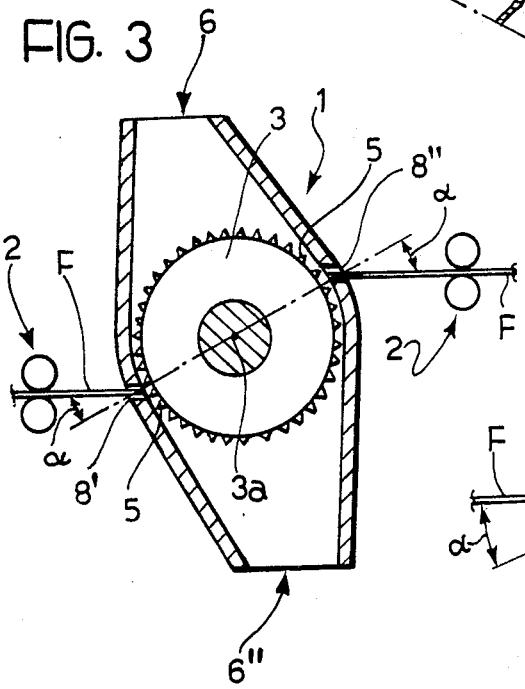
FIG. 3 illustrates a possible variant of FIG. 2.
Figure 2:
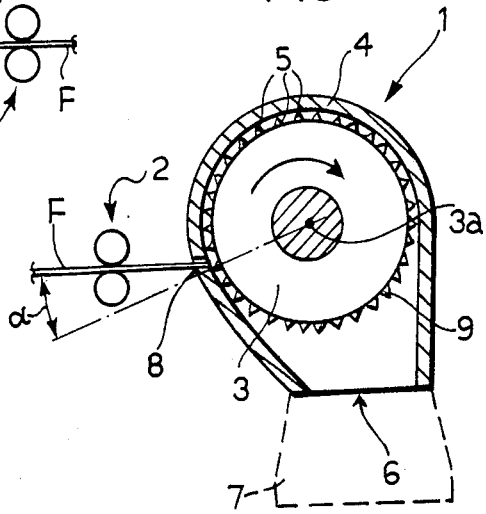
FIG. 2 is a section taken on line II—II of FIG. 1.

In FIGS. 1 to 3 an apparatus (defibrator) is illustrated schematically, and generally indicated 1, which is used for the dry defibration of sheets of fibrous cellulose material and like materials.

As already indicated above, the defibration operation is intended to convert, under dry conditions, a fibrous sheet material, such as a sheet of chemically-obtained wood pulp cellulose into a dispersion of individual fibres in air, which can be used as the basic material for the manufacture of absorbent masses of the type currently used in disposable nappies or diapers for children and incontinence pads, sanitary towels and the like for adults.

In a typical example of use, the sheets to be defibrated are constituted by cellulose pulp called "NBF" fluff manufactured by the Weyerhaeuser Company of Tacoma (United States of America). This material is provided wound on reels of different widths with diameters of up to 1520 mm. The thickness of the sheets is about 1.2 mm with a weight of about 680 g/m$^2$, while the moisture content is about 6%. Naturally there are other types of cellulose with different physical and chemical characteristics which can be used to advantage and effectively defibrated using the apparatus according to the invention.

The reference F indicates sheets of material to be defibrated which are fed to the apparatus 1 by respective pairs of counter-rotating motor-driven rollers 2. The speed of rotation of the rollers 2 can be adjusted so as to adapt the feed velocity of each sheet F to the timing of the production cycle in which the defibration 1 is inserted.

The feed rollers 2 are driven by a drive unit of known type. This drive unit, together with numerous other parts of the apparatus 1, the structure and characteristics of operation of which are known to the expert in the art, are not explicitly described here since they are not essential for the purpose of understanding the present invention.

Figure 4:
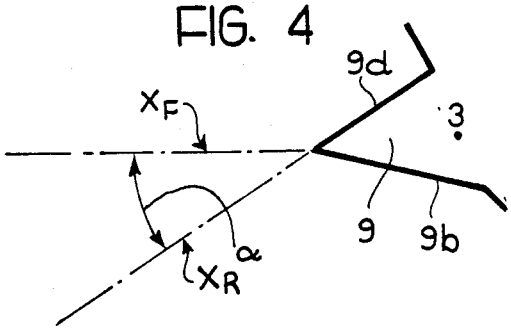
FIG. 4 illustrates schematically and on an enlarged scale, the shape and relative positioning of several of the elements illustrated in FIGS. 2 and 3.

While the manner in which the drive of the sheet F by the feed rollers 2 is adjusted is omitted from the description it is appropriate to stress that at least the leading portion of each sheet F fed to the defibrator 1 is oriented completely in a single plane indicated schematically by $X_F$ in FIG. 4.

The defibrator 1 illustated in FIGS. 1 and 2 includes, as an essential part, a cylindrical toothed rotor 3 which rotates at high speed about its main axis of symmetry 3*a* under the action of an electric motor (not illustrated).

The rotor 3 is surrounded by a casing or housing 4 surrounding the rotor 3 so as to define a space 5 around the rotor itself of arcuate shape and constant width which extends over the upper half of the rotor 3.

Beneath the toothed rotor 3, the housing or casing 4 has an aperture 6 which opens into a conventional chamber 7, schematically illustrated in broken outline in FIG. 2, for forming mats of fluff.

The sheets F are introduced into the casing 4 through a slot 8 the axial length of which is about equal to the axial length of the rotor 3 and the width of the sheets F, a width which is normally of the order of 500 mm.

Naturally it is possible to provide other slots in the periphery of the casing 4 for the feed of sheets F to be defibrated, each of which has associated therewith a respective group of feed rollers.

In particular, in the variant illustrated in FIG. 3—in which identical references indicate identical or equivalent parts to the parts illustrated in FIGS. 1 and 2—two feed inlets 8' and 8'' are provided diametrically opposite each other as well as two independent outlet apertures 6' and 6'' for the defibrated mat, also diametrically opposite each other. This arrangement results in more uniform wear of the teeth of the rotor 3. The presence of two independent outlet apertures each located downstream of a respective feed inlet avoids entrainment of the defibrated material at one of the inlets towards the other inlet, with a harmful effect on the defibrating process being carried out there. The configuration of the defibrator illustrated in FIG. 3 may also to advantage be used for feeding a sheet F to be defibrated to each inlet in alternating sequence: when a reel of sheet is exhausted, the feed members associated with the other reel are actuated. The defibration process is thus carried on the whole time without the need for interruption for replacement of the exhausted reel by a new reel which will subsequently be fed to the defibration on exhaustion of the reel supplying the other inlet.

As illustrated in FIGS. 1 to 3, the rotor 3 has external teeth 9 one of which is shown schematically on an enlarged scale in FIG. 4. This Figure shows a lateral view of one of the teeth 9 in a plane substantially perpendicular to the axis of rotation 3*a* of the rotor.

In defibrators of known type, as in the defibrator 1 of the invention, the rotor 3 is rotated at high speed about its axis 3*a* (in the clockwise sense with reference to the relative arrangement of the parts illustrated in the drawings) while the feed rollers 2 advance the sheets F into the casing 4 through the slot 8. The sheets are thus made to impinge on the toothed surface of the rotor 3. The teeth 9 of the rotor 3 collide violently with the free edge of the sheet F, penetrating it tangentially relative to the rotor 3 and causing the disintegration of the material of the sheets F. The material is thus dissociated (defibrated) into its individual constituent fibres, which are subsequently drawn by the rotor 3 into the space 5 and are then projected out of the defibrator 1 through the aperture 6 downstream of the feed inlet.

In order to facilitate the transport of the fibres by the rotor 3 into the casing 4 apertures or nozzles (not illustrated) may be provided through which pressurised air generated by a blower device (also not illustrated) is blown tangentially into the casing 4. Alternatively, use may be made of a sub-atmospheric pressure (vacuum) in the formation chamber 7 to draw air into the defibrator through the feed slots 8 or through other slots of the casing 4 (not illustrated).

The teeth 9 are arranged on the outer surface of the rotor 3 in regular distributions (for example distributions reproducing multiple-part coils) helical or in pseudo-random manner.

A characteristic feature of the defibrator according to the invention is the fact that, as shown schematically in FIGS. 2 to 4, the plane $X_F$ along which the sheets to be defibrated are fed to the defibrator is at an angle $\alpha$ other than zero to the radial or diametrical plane of the rotor 3 passing through the slot 8, a plane schematically shown at $X_R$ in FIG. 4.

The angle $\alpha$ is typically between 10° and 60° and is preferably chosen to be about 30°.

As illustrated in the same FIG. 4, the teeth 9 in general have a triangular profile which can be seen to consist of a front flank 9*a* and a rear flank 9*b*.

The terms "front" and "rear" naturally relate to the sense of rotation of the rotor 3 about its axis. The front flank 9*a* is thus that intended to impinge directly on the sheets F to be defibrated. It is substantially straight and extends in the radial or diametral plane of the rotor 3 passing through the apex of the tooth 9 itself.

The rear flank side 9*b* of each tooth is also straight and is at an angle of about 45° to the associated front flank 9*a*.

The arrangement described is such that, in the region in which the sheets F are fed against the rotor 3, that is to say, in the region in which a substantial part of the defibrating action is achieved, the front flank 9*a* of each tooth is at an obtuse angle to the plnae ($X_F$) of the sheet impinged upon by the tooth 9 itself. The size of this angle is 180°-$\alpha$°, where $\alpha$° is the magnitude in degrees of the angle $\alpha$ defined above.

The solution adopted in the apparatus according to the invention is particularly advantageous in view of the possibility of varying the angle $\alpha$ easily and consequently the angle of infringement of the front flanks 9*a* of the teeth 9 on the sheets F in dependence on the working requirements. In order to vary this angle it suffices to act on the feed device associated with the rollers 2 so as to vary the relative orientation of the feed plane $X_F$ to the radial plane $X_R$.

Figure 5:
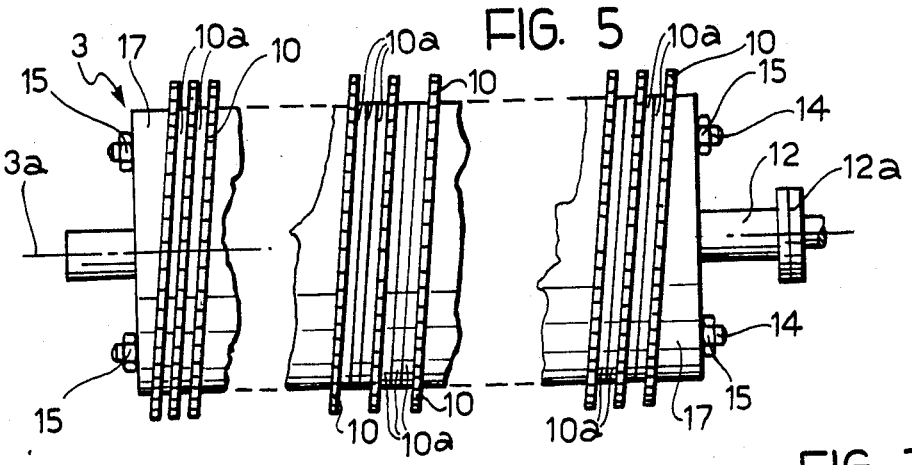
FIG. 5 illustrates separately in side elevation one of the elements illustrated in FIGS. 1 and 2.
Figure 7:
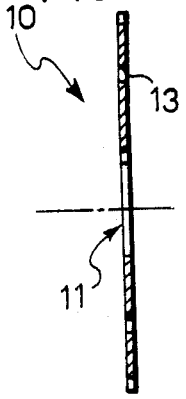
FIG. 7 is a section taken on the line VII—VII of FIG. 6.
Figure 6:
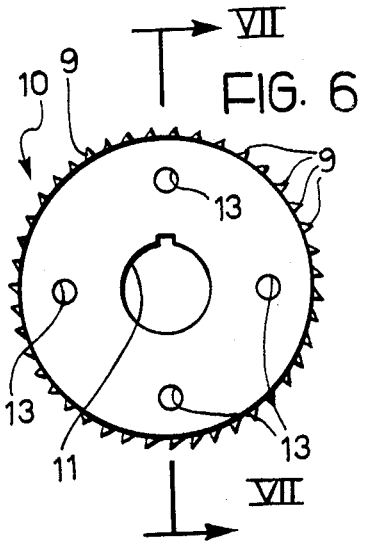
FIG. 6 is a side elevational view of one of the parts making up the element of FIG. 5.

With reference now to FIGS. 5 to 9, it is can be seen that the rotor 3 is constituted essentially by a pack of discs 10 which are identical to each other and one of which is illustrated in greater detail in FIGS. 6 and 7.

Each disc 10 is constituted essentially by a circular plate having a central aperture 11 which allows it to be keyed onto a support shaft 12. The shaft 12 is rotated about the main axis 3*a* of the rotor by a motor (not illustrated) through a coupling 12*a*.

Each disc 10 has a regular distribution of teeth on its periphery, each tooth having a triangular profile of the type shown schematically in FIG. 4.

By way of dimensional example, the discs used may to advantage have a thickness of 1.5—2 mm and an outer diameter of 280—300 mm and be provided with a ring of 36 teeth. Each tooth has a height, corresponding to the length of the front edge 9*a*, of 10 mm. The most important aspect of the invention is the fact that the discs 10 are mounted on the shaft 12 with an inclination to the axis of rotation 3*a*, instead of being perpendicular to said axis. In other words, each disc 10 lies in a plane inclined at an angle $\beta$ (FIG. 8) to planes perpendicular to the axis of rotation 3*a*, the preferred value of $\beta$, with reference to the dimensions of the discs given above, being between 1° and 6°. At present a value of about 2° is considered the optimum. In all the Figures of the drawings, the inclination has thus been deliberately exaggerated for clarity of illustration.

The oblique mounting of the discs 10 may easily be achieved by assembling the discs 10 themselves in a pack with the interposition of spacer discs 10*a* without teeth.

Both the toothed discs 10 and the spacer discs 10*a* have holes 13 for receiving connection rods 14 which pass through the disc—spacer pack longitudinally. The rods 14 have threaded ends on which nuts 15 are screwed to allow the pack thus formed to be clamped firmly together axially.

The pack is completed at its two ends by two shaped elements 17 of circular section with diameters slightly less than those of the toothed discs. Each shaped element 17 is defined by an outer face (relative to the disc-spacer pack) which, in the assembled disposition on the shaft 12, lies in a plane perpendicular to the axis 3*a* and an inner face lying in a plane which is at an angle to the planes perpendicular to the axis 3*a*, this angle being equal to the angle of inclination $\beta$ which it is desired to give the toothed discs 10.

The fact that the discs 10 are inclined on the shaft 12 means that when the shaft 12 is rotated, the toothed edge of each disc 10 describes a substantially cylindrical surface of a diameter equal to about 2R, where R is the radius of the discs, and a width equal to 2R tan $\beta$ or, more precisely 2R sin $\beta$, where $\beta$ is the angle between the plane of the disc and planes perpendicular to the axis of rotation 3*a*. By arranging that the toothed edge of the disc describes the said cylindrical surface it is ensured that each point on this surface is affected by the action of the teeth 9. In effect the surface described by the edge of each disc 10 has a generally barrel shaped profile, gradually tapering towards its axial ends. This profile may, however, be considered as negligible when the value normally chosen for the angle $\beta$ is about 2°.

Figure 8:
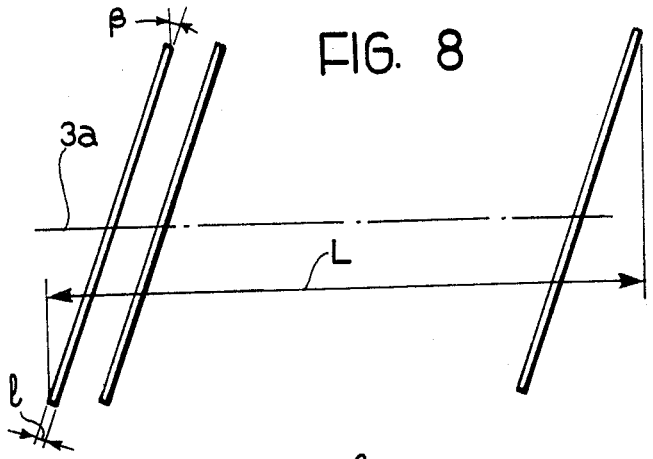
FIGS. 8 and 9 illustrate schematically the criteria used for the assembly of the element illustrated in FIG. 5.

One of the advantages resulting from the inclined disposition of the discs 10 may be explained schematically with reference to FIG. 8.

Supposing in general that it is desired to form a rotor 3 with a width (axial extent) L of 500 mm: if discs of the type illustrated in FIGS. 5 and 6 are used with a thickness L' of 1.5 mm disposed—according to the prior art—in planes perpendicular to the axis 3*a*, it is necessary to use a number of discs N equal to L/L' or about 334 toothed discs.

According to the invention, using identical discs with a diameter of about 300 mm inclined at an angle $\beta$ of about 2° to planes perpendicular to the axis 3*a*, it is possible to use a smaller number of discs N' equal to L/2R tan $\beta$, that is to say 48 toothed discs.

Even without resorting to this minimum value, the invention allows a considerable saving in toothed discs 10. This saving is particularly important in economic terms if account is taken of the fact that the manufacture of the discs 10 is in general very complex and onerous both due to the need to provide anti-wear treatments for the metal materials used and due to the need to form the teeth 9 on the periphery of the discs 10.

Another considerable advantage results from the possibility of adapting the characteristics of the rotor 3 easily to the characteristics of the material to be defibrated and to the defibration results it is desired to achieve.

Figure 9:
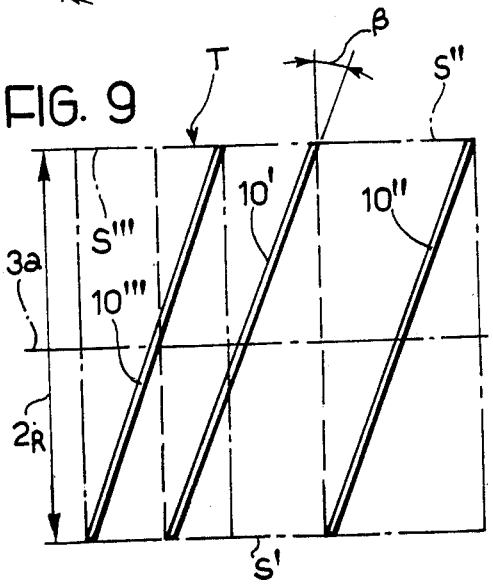

This possibility is illustrated schematically in FIG. 9 in which three adjacent discs 10', 10'' and 10''' are shown schematically, each of these lying in a plane at a predetermined angle $\beta$ to planes perpendicular to the axis of rotation 3*a* of the rotor.

For clarity of illustration, both the distance between adjacent discs and the angle of inclination $\beta$ have been greatly increased relative to the apparent diameter of the discs themselves.

The cylindrical surface of rotation described by the disc 10' is indicated S'. The cylindrical surface described by the disc 10'' is, indicated S''. Finally the cylindrical surface of rotation described by the disc 10''' is indicated schematically as S'''.

The distance between the discs 10' and 10'' is adjusted (by the insertion of a corresponding number of spacers 10*a*) so that the surfaces S' and S'' adjoin each other along their mutually facing margins or edges, without overlapping axially.

According to the terminology adopted in the claims below, the surfaces S' and S'' "mate marginally" since they adjoin each other in correspondence with their mutually facing end margins or edges.

Under these conditions, any point on the cylindrical surface defined by the surfaces S' and S'' is affected either by the action of the teeth of the disc 10' or the action of the teeth of the disc 10''.

Naturally, a choice of a distance between the discs 10' and 10'' greater than that illustrated could lead to an undesirable break in the continuity of the surfaces S' and S'', that is to say the formation of a cylindrical zone which, during rotation of the rotor 3, would not be affected by the action of the teeth of the disc 10' or by the action of the teeth of the disc 10''.

The relative disposition of the disc 10' and the disc 10''' is, however, different. In this case the distance between the two adjacent discs is chosen so that the surface S' and the surface S''' have a zone of overlap T.

The surfaces S' and S''' are thus more than marginally mating and any point which is on the surface of the zone of overlap T is subject both to the action of the teeth of the disc 10' and to the action of the teeth of the disc 10'''.

Since the quality of the defibration operation depends—among other things—on the frequency of the impacts of the teeth 9 on the sheets F, a variation in the assembly of the discs 10 according to the criteria schematically illustrated with reference to FIG. 9 makes it possible to adjust the number of impacts for a given angular velocity of the rotor 3 and a given number of teeth 9 on each disc.

One may thus change from a configuration which provides a minimum number of impacts (cylindrical surfaces described by adjacent "marginally mating" discs such as the surfaces S' and S'' of FIG. 9) to a configuration with a higher frequency of impact (or apparent density of teeth 9)—that is, overlapping cylindrical surfaces described by adjacent discs such as the surfaces S' and S''' of FIG. 9.

Still with reference to FIG. 9, it is clear that it is possible to adjust the distance between adjacent discs so that the entire toothed surface of the rotor 3 is constituted ideally, by cylindrical overlapping zones of the type indicated by T, without a break in continuity over the entire axial length of the rotor.

In general, the distance between two adjacent discs 10 may be adjusted by the selection of the number of spacer elements 10*a* interposed between them.

Thus, in the left hand portion of FIG. 5, an assembled configuration of the rotor 3 is shown in which only a single spacer element 10*a* is interposed between two adjacent discs 10. One is thus considering an assembled configuration intended to ensure a very high number of impacts by the teeth 9 on the material F to be defibrated.

The central portion of FIG. 5, however, shows an alternative assembly arrangement in which adjacent discs 10 are separated by a plurality of spacer elements 10*a*. This assembly configuration achieves a frequency of impact on the material to be defibrated which is the minimum compatible with the requirement of avoiding the formation of zones between the cylindrical surfaces described by adjacent discs which are not subject to impact by the teeth.

In the right hand portion of the same Figure there is again shown another possible assembly configuration for the rotor 3. This is, as it were, an intermediate arrangement between those explained above in which there are, for example, two spacer elements 12 between adjacent pairs of discs 10.

Again with reference to FIG. 9 one may finally observe that an effect of adjusting the number of impacts of the teeth substantially similar to that which can be achieved by variation of the distance between adjacent discs 10 may also be achieved by varying the value of the angle $\beta$ of inclination of the discs which determines the axial height of the cylindrical surfaces described by the discs 10 themselves. As indicated above, the size of this angle is preferably chosen to be about 2° but may vary typically between about 1° and about 6°.

In a particular embodiment currently preferred, the rotor is constituted by 185 toothed discs and 185 spacer discs disposed in alternating sequence and having equal thicknesses of about 1.5 mm. The outer diameter of the toothed discs is 280 mm. There are 36 equidistant teeth on the periphery of each disc, each having a front edge 9*a* about 10 mm long. The angle $\beta$ is chosen to be 2° and each toothed disc is rotated angularly through 4° relative to the adjacent toothed discs. In axial extent, the rotor is divided ideally into two halves, characterised by opposite senses of relative inclination between adjacent toothed discs in the two halves.

In operation, the peripheral speed of the rotor is about 70 m/sec. The angle $\alpha$ is about 30°.

Under these conditions, when working on a cellulose NBF pulp made by the Weyerhaeuser Company at about 600 kg/h, an overall power consumption of about 18 KW is required at the axis of the rotor. The quality of the defibrated product is such as to allow its direct use as the absorbent mass for nappies for new-born babies.

The said value of the power consumption is, surprisingly, lower than that of conventional defibrators of equal production capacity. While not wishing to link this to any particular theoretical explanation, the Applicants are of the opinion that this result is due essentially to the fact that, in the defibrator according to the invention, the penetration of the teeth into the cellulose sheet being worked is achieved more progressively than in prior art defibrators.

The principle of the invention remaining the same, the constructional details and embodiments may be varied widely with respect to that described and illustrated.

For example, in order to optimise the defibration conditions, it may be advantageous to provide toothed discs 10 with rings of teeth 9 which are angularly spaced apart in a non-uniform manner so as to avoid excessive crowding of the impacts on the cellulose sheet in any regions of the angular path of rotation of the disc and the rotor.

These variants naturally fall within the scope of the present invention.

We claim:

1. Apparatus for the dry defibration of sheets of fibrous cellulose material, comprising a generally cylindrical rotor, rotatable about its main axis and having teeth on its outer surface for impinging upon the material to be defibrated, and a casing surrounding the rotor into which the sheets to be defibrated are fed wherein:

the rotor comprises a plurality of discs each having an outer toothed edge, said discs being connected together in a pack in an arrangement in which each disc lies in a plane at a predetermined angle ( ↑ ) other than zero to planes perpendicular to the main axis of the rotor, so that during rotation of the rotor, the outer toothed edge of each disc describes a respective substantially cylindrical surface (S') coaxial with said main axis at least marginally mating with similar surfaces (S'', S''') described by the outer toothed edges of the adjacent discs, each tooth of the rotor has a front flank which is intended to impinge upon the mateiral to be defibrated and which lies substantially in a respective radial plane of the rotor, and said casing having an aperture located to receive the sheets of material to be defibrated in a feed plane which is at a predetermined angle (a) to said radial plane of the rotor which passes through a region at which the sheets are fed into the casing, said feed plane of the sheets to be defibrated being at an angle of less than 180° to the passing radial plane of the rotor.

2. Apparatus as claimed in claim 1 further comprising spacer members, free of teeth, interposed between the toothed discs.

3. Apparatus as claimed in claim 1, wherein the toothed discs lie in planes at an angle ($\beta$) of between about 1° and about 6°, to the main axis of the rotor.

4. Apparatus as claimed in claim 1, wherein the toothed discs lie in planes at an angle ($\beta$) of about 2° to the main axis of the rotor.

5. Apparatus as claimed in claim 1 wherein the said predetermined angle ($\alpha$) between the feed plane of the sheets of material to be defibrated and the radial plane of the rotor passing through the feed region is between about 10° and about 60°.

6. Apparatus as claimed in claim 1, wherein the said predetermined angle ($\alpha$) between the feed plane of the sheets of material to be defibrated and the radial plane of the rotor passing through the feed region is about 30°.

7. Apparatus as claimed in claim 1 wherein the teeth (9) of the rotor (3) have each a rear flank at an angle substantially equal to 45° to the said respective radial plane.

8. Apparatus as claimed in claim 1 wherein teeth are provided on the toothed edge of the discs which are distributed in a non-uniform manner with respect to the angular development of the edge itself.

9. Apparatus as claimed in claim 1, wherein the casing has at least one pair of apertures for receiving the sheets to be defibrated, these being diametrically opposite each other, and at least two outlet apertures for the defibrated material, also approximately diametrically opposite each other; each of the outlet apertures being downstream of a respective feed aperture in the sense of rotation of the rotor in order substantially to limit the transport of defibrated material from one of the feed apertures to the other.

* * * * *

UNITED STATES PATENT AND TRADEMARK OFFICE

CERTIFICATE OF CORRECTION

PATENT NO. : 4,673,136

DATED : June 16, 1987

INVENTOR(S) : Carlo Bianco et al

It is certified that error appears in the above-identified patent and that said Letters Patent is hereby corrected as shown below:

Column 1, line 12, change "babies" to --babies'--.

Column 3, line 62, replace "defibration" with --defibrator--.

Column 5, line 14, replace "multiple-part" with --multiple-start--.

Column 5, line 41, replace "plnae" with --plane--.

Column 8, line 38, replace "surfaces" with --surface--.

Column 9, line 27, replace "( ↑ )" with --( β )--.

Column 9, line 41, replace "(a)" with --( α )--.

Signed and Sealed this

Twenty-second Day of September, 1987

*Attest:*

DONALD J. QUIGG

*Attesting Officer* *Commissioner of Patents and Trademarks*